US009897325B2

(12) United States Patent
Kang et al.

(10) Patent No.: US 9,897,325 B2
(45) Date of Patent: Feb. 20, 2018

(54) LIGHT-EMITTING KNOB ASSEMBLY

(71) Applicant: Dartpoint Tech. Co., Ltd., Taipei (TW)

(72) Inventors: Chi-Lin Kang, New Taipei (TW); Jian-jou Chan, New Taipei (TW); Chung-Hsin Hsieh, Taipei (TW)

(73) Assignee: DARTPOINT TECH. CO., LTD., Taipei (TW)

( * ) Notice: Subject to any disclaimer, the term of this patent is extended or adjusted under 35 U.S.C. 154(b) by 108 days.

(21) Appl. No.: 15/139,702

(22) Filed: Apr. 27, 2016

(65) Prior Publication Data

US 2016/0320040 A1 Nov. 3, 2016

(30) Foreign Application Priority Data

Apr. 28, 2015 (TW) ..... 104113560 A

(51) Int. Cl.

| | |
|---|---|
| ***F21V 9/00*** | (2015.01) |
| ***F24C 3/12*** | (2006.01) |
| ***H05B 33/08*** | (2006.01) |
| ***F24C 7/08*** | (2006.01) |
| ***H01H 19/62*** | (2006.01) |
| *F21V 33/00* | (2006.01) |
| *H01H 19/14* | (2006.01) |

(52) U.S. Cl.

CPC ..... *F24C 3/124* (2013.01); *F24C 7/082* (2013.01); *H01H 19/62* (2013.01); *H05B 33/0842* (2013.01); *F21V 33/0044* (2013.01); *H01H 19/14* (2013.01)

(58) Field of Classification Search

USPC ..... 361/231, 276

See application file for complete search history.

(56) References Cited

U.S. PATENT DOCUMENTS

| | | | | |
|---|---|---|---|---|
| 6,733,146 | B1 * | 5/2004 | Vastano | G05G 1/105 362/23.02 |
| 8,851,692 | B2 | 10/2014 | Baier | |
| 2006/0244559 | A1 | 11/2006 | Hamm | |
| 2012/0090970 | A1 | 4/2012 | Yoshida | |

FOREIGN PATENT DOCUMENTS

| | | |
|---|---|---|
| CN | 102165548 | 8/2011 |
| CN | 102374559 | 3/2012 |
| CN | 204063153 | 12/2014 |
| DE | 1274307 | 8/1968 |
| DE | 10218294 | 11/2003 |

* cited by examiner

*Primary Examiner* — Jamara Franklin

(74) *Attorney, Agent, or Firm* — Mark M. Friedman

(57) ABSTRACT

A light-emitting knob assembly is disclosed. The light-emitting knob assembly is disposed on a device for providing a heat source or a fire and includes a knob, a light-sensing plate, an axial bush, a base, and a light generating unit. The knob is utilized for being rotated to control the strength of the heat source or the strength of the fire of the device and driving the light-sensing plate and the axial bush to be rotated relative to the light generating unit. The light generating unit generates different brightnesses and/or different colors of lights to correspondingly display the strength of the heat source or the strength of the fire after the light-sensing plate is rotated. A user can distinguish the strength of the heat source or the strength of the fire via the light-emitting knob assembly from a distance.

9 Claims, 8 Drawing Sheets

LIGHT-EMITTING KNOB ASSEMBLY

CROSS REFERENCE TO RELATED APPLICATIONS

This application claims the priority of Taiwan Patent Application No. 104113560, filed on Apr. 28, 2015. The contents of the Taiwan patent application are entirety incorporated herein by reference.

FIELD OF THE INVENTION

The present invention relates to a knob assembly, and more particularly to a light-emitting knob assembly.

BACKGROUND

In prior art, devices for providing a heat source or fire (such as gas stoves, furnaces and electric stoves . . . ) are controlled by a knob, to adjust the strength of the heat source or the strength of the fire. However, the devices for providing a heat source or fire only display the strength of the heat source or the strength of the fire on panels on where the knobs are disposed, users at a distance are unable to know the strength of the heat source or the strength of the fire, hence, the users must come closer to the devices for providing a heat source or fire to know the strength of the heat source or the strength of the fire on the panels. It is not convenient to the users who want to know the strength of the heat source or the strength of the fire at a distance.

Consequently, there is a need to solve the above-mentioned problem that the user can't know the strength of the heat source or the strength of the fire at a distance.

SUMMARY OF THE INVENTION

In order to solve the above-mentioned problem, an object of the present invention is to provide a light-emitting knob assembly, which is able to solve the above-mentioned problem that the user cant know the strength of the heat source or the strength of the fire at a distance.

In order to achieve the object, a light-emitting knob assembly of the present invention is disposed on a device for providing a heat source or fire, the light-emitting knob assembly comprises a knob, a light-sensing plate, an axial bush, a base, and a light generating unit. The light-sensing plate is fixed in the knob. One terminal of the axial bush is fixed in the knob, one other terminal of the axial bush is configured for being rotatably connected with the device. The light generating unit is fixed in the base. The knob is utilized for being rotated to control the strength of the heat source or the strength of the fire of the device, and driving the light-sensing plate and the axial bush to be rotated relative to the light generating unit, the light generating unit generates different brightnesses and/or different colors of lights according to corresponding different regions after the light-sensing plate is rotated, to correspondingly display the strength of the heat source or the strength of the fire.

In one preferred embodiment, the light generating unit comprises a printed circuit board assembly, a control unit, at least one light sensor and at least one light-emitting diode. The control unit is disposed on the printed circuit board assembly. The at least one light sensor is disposed on the printed circuit board assembly and is electrically connected to the control unit, and senses different lights reflected by figures of the different regions of the light-sensing plate, after rotating the light-sensing plate, to generate different control signals. The at least one light-emitting diode is disposed on the printed circuit board assembly and is electrically connected to the control unit, wherein the control unit control the at least one light-emitting diode to generate different brightnesses and/or different colors of lights, according to the different control signals.

In one preferred embodiment, the light generating unit further comprises a power unit and a micro switch. The power unit is at least used to provide power to the at least one light-emitting diode. The micro switch is electrically connected with the control unit and the power unit, the micro switch is activated to stop the power unit from providing power when the knob is rotated to a certain position.

In one preferred embodiment, the other terminal of the axial bush penetrates the light-sensing plate and rotatably connects with the device.

In order to achieve the object, a light-emitting knob assembly of the present invention is disposed on a device for providing a heat source or fire, the light-emitting knob assembly comprises a knob, a driving unit, an axial bush, a base, and a light generating unit. The driving unit is fixed in the knob. One terminal of the axial bush is fixed in the knob, one other terminal of the axial bush is configured for being rotatably connected with the device. The light generating unit is fixed in the base. The knob is utilized for being rotated to control the strength of the heat source or the strength of the fire of the device, and driving the driving unit and the axial bush to be rotated relative to the light generating unit, the light generating unit generates different brightnesses according to a rotating level of the driving unit with respect to the light generating unit after the driving unit is rotated, to correspondingly display the strength of the heat source or the strength of the fire.

In one preferred embodiment, the driving unit comprises a sliding rail, the light generating unit comprises a printed circuit board assembly, a slide potentiometer and at least one light-emitting diode. The slide potentiometer is disposed on the printed circuit board assembly and comprises a sliding rod, the sliding rod is slidably disposed in the sliding rail. The at least one light-emitting diode is disposed on the printed circuit board assembly and is electrically connected to the slide potentiometer. When the knob rotates to make the driving unit rotate, the sliding rail of the driving unit makes the sliding rod move, to adjust a resistance value of the slide potentiometer, and the at least one light-emitting diode generates light corresponding to the resistance value.

In one preferred embodiment, the light generating unit further comprises a power unit and a micro switch. The power unit is used to provide power to the at least one light-emitting diode. The micro switch is electrically connected with the power unit and the slide potentiometer, the micro switch is activated to stop the power unit from providing power when the knob is rotated to a certain position.

In one preferred embodiment, the other terminal of the axial bush penetrates the driving unit and rotatably connects with the device.

In one preferred embodiment, the driving unit comprises a connecting rod and a pin, the connecting rod connects the knob via the pin. The light generating unit comprises a printed circuit board assembly, a slide potentiometer and at least one light-emitting diode. The slide potentiometer is disposed on the printed circuit board assembly and comprises a sliding rod, the sliding rod is slidably disposed in the connecting rod. The at least one light-emitting diode is disposed on the printed circuit board assembly and is electrically connected to the slide potentiometer. When the knob rotates to make the driving unit rotate, the connecting rod of the driving unit makes the sliding rod move, to adjust a resistance value of the slide potentiometer, and the at least one light-emitting diode generates light corresponding to the resistance value.

In one preferred embodiment, the light generating unit further comprises a power unit and a micro switch. The power unit is used to provide power to the at least one light-emitting diode. The micro switch is electrically connected with the power unit and the slide potentiometer, the micro switch is activated to stop the power unit from providing power when the knob is rotated to a certain position.

Compared with the prior art, the user can know the strength of the heat source or the strength of the fire from a distance by the light-emitting knob assembly of the present invention. Moreover, the light-emitting knob assembly of the present invention has beautiful and decorative function when emitting light.

DETAILED DESCRIPTION OF THE INVENTION

Figure 1A:
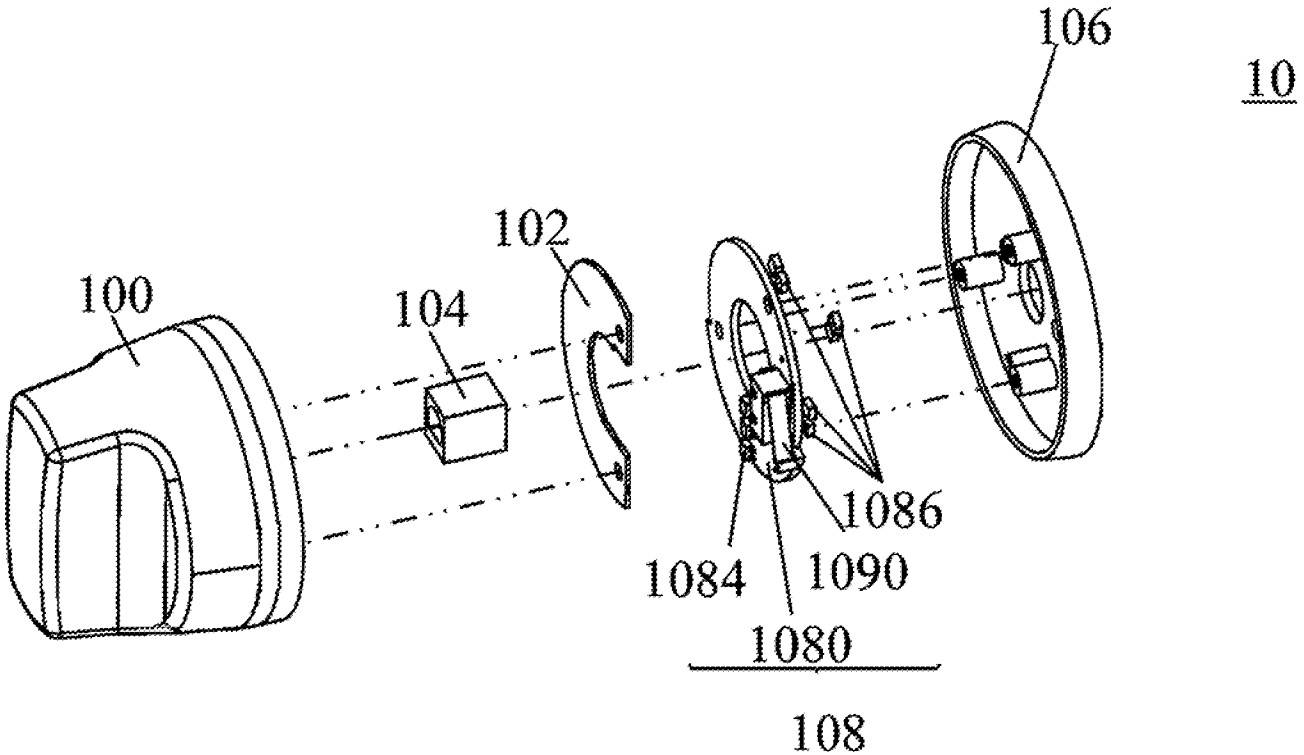
FIG. 1A is an exploded view of a light-emitting knob assembly in accordance with a first embodiment of the present invention.

This description of the exemplary embodiments is intended to be read in connection with the accompanying drawings, which are to be considered part of the entire written description. In the description, relative terms such as "lower", "upper", "horizontal", "vertical", "above", "below", "up", "down", "top", and "bottom" as wen as derivatives thereof (e.g., "horizontally", "downwardly", "upwardly", etc.) should be construed to refer to the orientation as then described or as shown in the drawing under discussion. These relative terms are for convenience of description and do not require that the apparatus be constructed or operated in a particular orientation, and do not limit the scope of the invention.

Figure 1B:
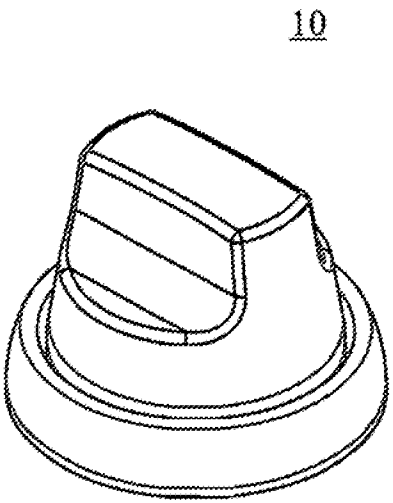
FIG. 1B is an isometric, assembled view of the light-emitting knob assembly of FIG. 1A.

Please refer to FIG. 1A and FIG. 1B. FIG. 1A is an exploded view of a light-emitting knob assembly 10 in accordance with a first embodiment of the present invention. FIG. 1B is an isometric, assembled view of the light-emitting knob assembly 10 of FIG. 1A.

The light-emitting knob assembly 10 is disposed on a device (not shown) for providing a heat source or fire and includes a knob 100, a light-sensing plate 102, an axial bush 104, a base 106 for being fixedly connected to the device, and a light generating unit 108. The device for providing a heat source or fire is such as but not limited to a gas stove, furnace, or electrical stove.

The knob 100 is utilized for being rotated to control the strength of the heat source or the strength of the fire of the device.

The light-sensing plate 102 is fixed in the knob 100. In the preferred embodiment, the light-sensing plate 102 is a semicircular and hollow plate, more specifically, a shape of the light-sensing plate 102 is not limited to the shape and/or figure as shown in FIG. 1A.

One terminal of the axial bush 104 is fixed in the knob 100, the other terminal of the axial bush 104 is rotatably connected with the device. More specifically, there is a corresponding axle in the device for providing heat source or fire, the other terminal of the axial bush 104 penetrates the light-sensing plate 102 and rotatably connects with the corresponding axle of the device for providing the heat source or fire.

The light generating unit 108 is fixed in the base 108. The knob 100 is utilized for being rotated to control the strength of the heat source or the strength of the fire of the device, and driving the light-sensing plate 102 and the axial bush 104 to be rotated relative to the light generating unit 108. The light generating unit 108 generates different levels of brightness and/or different colors of lights according to corresponding different regions of the light-sensing plate 102 after the light-sensing plate 102 is rotated, to correspondingly display the strength of the heat source or the strength of the fire.

Figure 2:
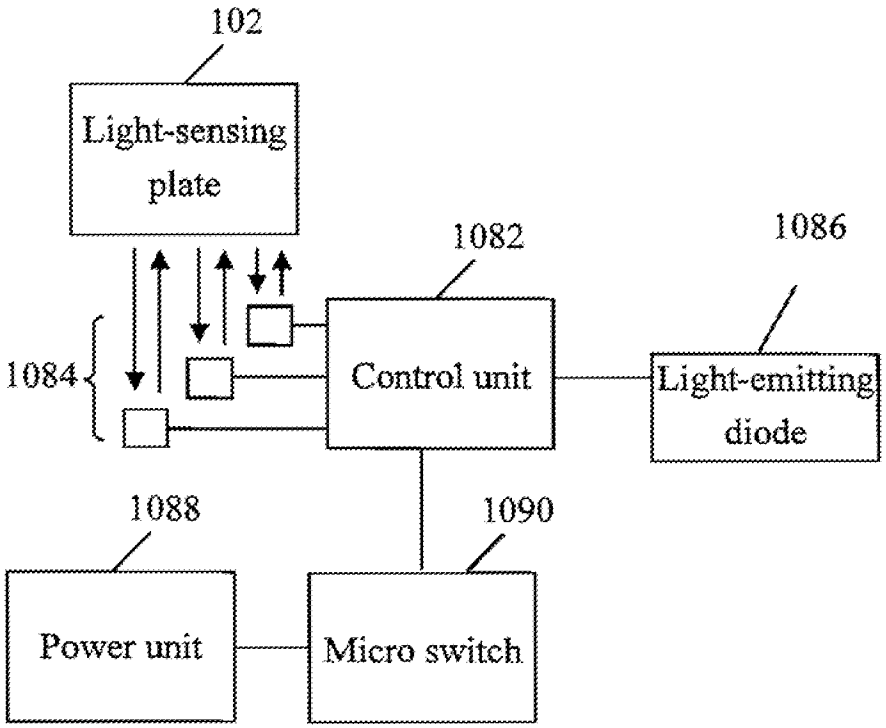
FIG. 2 is a block diagram of interior electrical elements of the light-emitting knob assembly of FIGS. 1A and 1B.

Please refer to FIG. 1A and FIG. 2. FIG. 2 is a block diagram of interior electrical elements of the light-emitting knob assembly 10 of FIGS. 1A and 1B. The light generating unit 108 comprises a printed circuit board assembly (PCBA) 1080, a control unit 1082, at least one light sensor 1084, at least one light-emitting diode 1086, a power unit 1088, and a micro switch 1090.

The control unit 1082 is disposed on the printed circuit board assembly 1080. The at least one light sensor 1084 is disposed on the printed circuit board assembly 1080 and is electrically connected to the control unit 1082. The at least one light sensor 1084 senses different lights reflected by figures of the different regions of the light-sensing plate 102 (as the figure shown in the FIG. 4), after rotating the light-sensing plate 102, to generate different control signals. The at least one light-emitting diode 1086 is disposed on the printed circuit board assembly 1080 and is electrically connected to the control unit 1082. The control unit 1082 control the at least one light-emitting diode 1086 to generate different levels of brightness and/or different colors of lights, according to the different control signals. More specifically, the at least one light sensor 1084 has a built-in light source, lights generated by the built-in light source of the at least one light sensor 1084 is reflected by the light-sensing plate 102, then being sensed by the at least one light sensor 1084, to generate the control signals. In another preferred embodiment, an additional light source is disposed on the printed circuit board assembly 1080, and no built-in light source is used within the at least one light sensor 1084.

Figure 3:
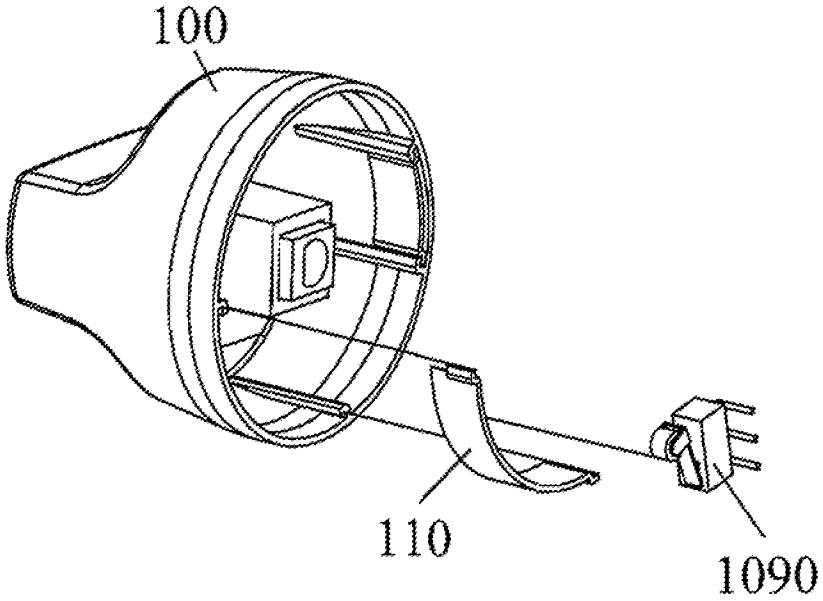
FIG. 3 is a partially exploded view of the light-emitting knob assembly of the present invention in which a micro switch and a wear plate are taken out.

The power unit 1088 is at least used to provide power to the at least one light-emitting diode 1086 and the control unit 1082. The position of the power unit 1088 is not limited; the power unit 1088 can be disposed inside or outside of the light-emitting knob assembly 10. The micro switch 1090 is electrically connected with the control unit 1082 and the power unit 1088; the micro switch 1090 is activated to stop the power unit 1088 from providing power when the knob 100 is rotated to a certain position. More specifically, the certain position corresponds to OFF state of the device for providing heat source or fire. Please refer to FIG. 3. FIG. 3 particularly show the micro switch 1090 and a wear plate 110 of the light-emitting knob assembly 10. When rotating the knob 100, the micro switch 1090 contacts with the wear plate 110 inside the knob 100, to start up the power unit 1088 of FIG. 2. When the knob 100 is rotated to the position corresponding to OFF state, the micro switch 1090 does not contact with the wear plate 110, and the power unit 1088 of FIG. 2 stops providing power, thereby to increase a using time of the power unit 1088.

Figure 4:
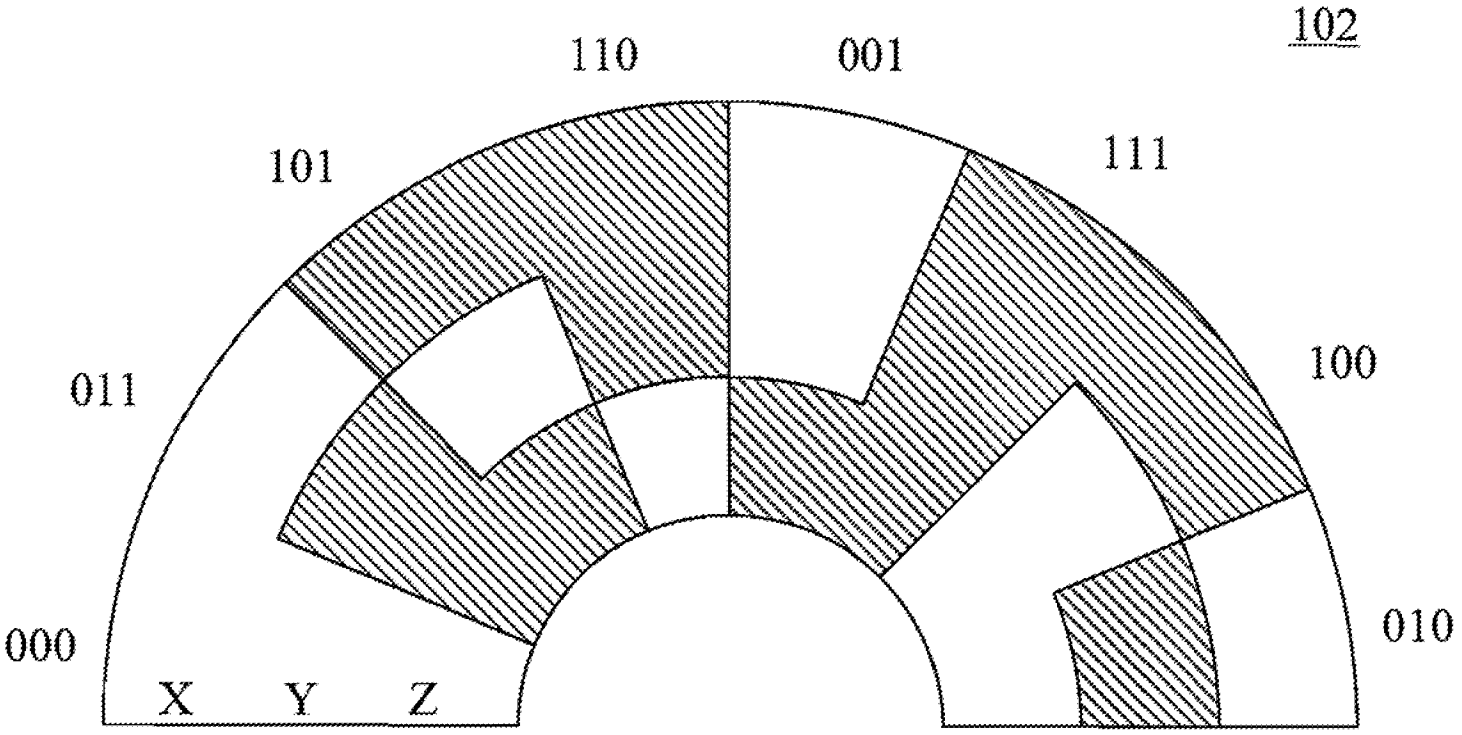
FIG. 4 is an illustrative drawing of a light-sensing plate of the light-emitting knob assembly in accordance with the first embodiment of the present invention.

Please refer to FIG. 1A, FIG. 2, and FIG. 4. FIG. 4 is an illustrative drawing of the light-sensing plate 102 in accordance with the first embodiment of the present invention.

As shown in FIG. 4, the light-sensing plate 102 has bright-dark pattern and comprises a first circle X, a second circle Y, and a third circle Z. The first circle X, the second circle Y, and the third circle Z can be coded to be sensed by the light sensor 1084, to generate different control signals. The chart below shows codes of the light-sensing plate 102 with respect to light with different strengths generated by the at least one light-emitting diode 1086, wherein "0" corresponds with blank areas of FIG. 4, and "1" corresponds with slash areas of FIG. 4 (in practice, it is an painted opaque area). Blank areas and slash areas will reflect lights with different strengths to be sensed by the light sensor 1084. In the chart below, the light-sensing plate 102 can reflect 8 levels of lights, so it is needed to have three light sensors 1084 ($2^3$=8). In another embodiment, the light-sensing plate 102 may reflect less levels than eight light levels (such as 6 levels), however, three light sensor 1084 are still used to sense. Besides, the quantity of the light sensors is not limited to three.

| Level | 1 | 2 | 3 | 4 | 5 | 6 | 7 | 8 |
|---|---|---|---|---|---|---|---|---|
| Code XYZ | 000 | 011 | 101 | 110 | 001 | 111 | 100 | 010 |
| Strength | | | | Weak→Strong | | | | |

For example, when the knob 100 rotates to make the light-sensing plate 102 rotate with respect to the light sensor 1084, the light sensor 1084 senses the first circle X, the second circle Y, and the third circle Z of the light sensing plate 102 is "000". The light sensor 1084 generates a control signal corresponding to "000" and transmits the control signal to the control unit 1082; the control unit 1082 controls the light-emitting diode 1086 to generate a weakest brightness light, which represents the device for providing heat source or fire is adjusted to a weakest strength of heat source or fire.

Relatively, when the light sensor 1084 senses the first circle X, the second circle Y, and the third circle Z of the light sensing plate 102 is "010", the light sensor 1084 generates a control signal corresponding to "010" and transmits the control signal to the control unit 1082. The control unit 1082 controls the light-emitting diode 1086 to generate a strongest brightness light, which represents the device for providing heat source or fire is adjusted to a strongest strength of heat source or fire.

Figure 5:
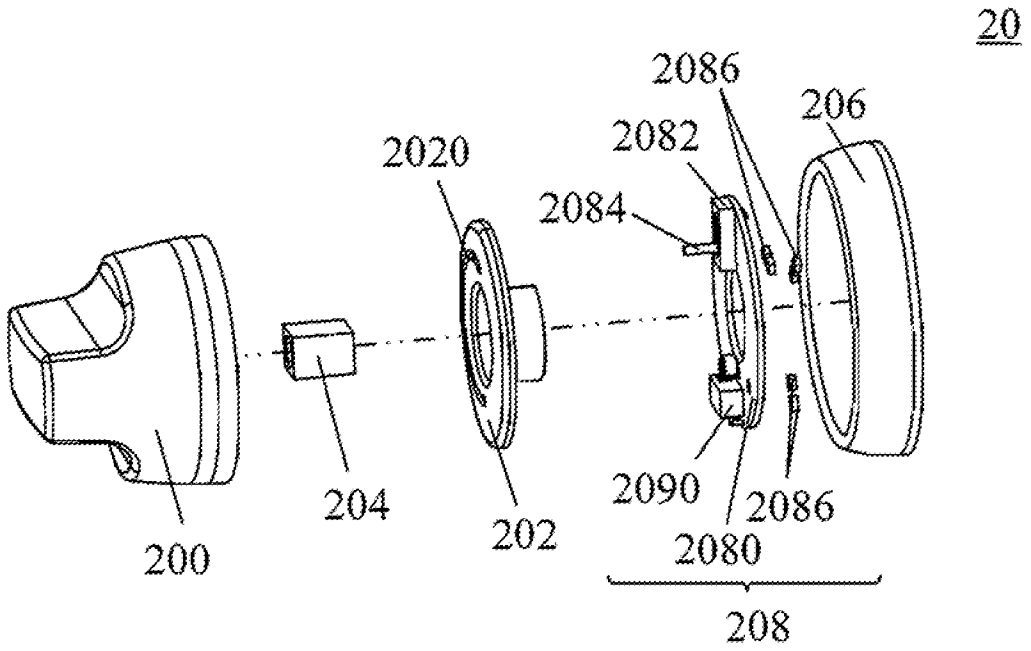
FIG. 5 is an exploded view of a light-emitting knob assembly in accordance with a second embodiment of the present invention.

Please refer to FIG. 5. FIG. 5 is an exploded view of a light-emitting knob assembly 20 in accordance with a second embodiment of the present invention. The isometric, assembled view of the light-emitting knob assembly 20 of the second embodiment of the present invention can be referred to FIG. 1B.

The light-emitting knob assembly 20 is disposed on a device (not shown) for providing a heat source or fire and includes a knob 200, a driving unit 202, an axial bush 204, a base 206 for being fixedly connected to the device and a light generating unit 208. The device for providing a heat source or fire is such as but is not limited to a gas stove, furnace, or electrical stove.

The knob 200 is utilized for being rotated to control the strength of the heat source or the strength of the fire of the device for providing a heat source or fire.

The driving unit 202 is fixed in the knob 200. One terminal of the axial bush 204 is fixed in the knob 200, the other terminal of the axial bush 204 is rotatably connected with the device for providing heat source or fire. More specifically, there is a corresponding axle in the device for providing heat source or fire; the other terminal of the axial bush 204 penetrates the driving unit 202 and rotatably connects with the corresponding axle of the device for providing the heat source or fire.

The light generating unit 208 is fixed in the base 206. The knob 200 is utilized for being rotated to control the strength of the heat source or the strength of the fire of the device, and driving the driving unit 202 and the axial bush 204 to be rotated relative to the light generating unit 208. The light generating unit 208 generates different levels of brightness of lights according to a rotating level of the driving unit 202 with respect to the light generating unit 208 after the driving unit 202 is rotated, to correspondingly display the strength of the heat source or the strength of the fire.

Figure 6:
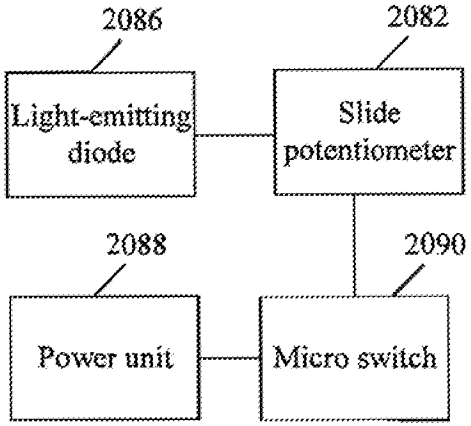
FIG. 6 is a block diagram of interior electrical elements of the light-emitting knob assembly of FIG. 5.

Please refer to FIG. 5 and FIG. 6. FIG. 6 is a block diagram of interior electrical elements of the light-emitting knob assembly 20 of FIG. 5. The light generating unit 208 comprises a printed circuit board assembly 2080, a slide potentiometer 2082, at least one light-emitting diode 2086, a power unit 2088, and a micro switch 2090.

The driving unit 202 is a round plate and a sliding rail 2020 is formed herein. The slide potentiometer 2082 is disposed on the printed circuit board assembly 2080 and comprises a sliding rod 2084. The sliding rod 2084 is slidably disposed in the sliding rail 2020. The at least one light-emitting diode 2086 is disposed on the printed circuit board assembly 2080 and is electrically connected to the slide potentiometer 2082. When the knob 200 rotates to make the driving unit 202 rotate, the sliding rail 2020 of the driving unit 202 makes the sliding rod 2084 move, to adjust a resistance value of the slide potentiometer 2082, and to change a current passing through the light-emitting diode 2086. Then, the at least one light-emitting diode 2086 generates light corresponding to the current which is inversely proportional to the resistance value.

The power unit 2088 is used to provide power to the at least one light-emitting diode 2086. The position of the power unit 2088 is not limited; the power unit 2088 can disposed inside or outside of the light-emitting knob assembly 20. The micro switch 2090 is electrically connected with the power unit 2088 and the slide potentiometer 2082. The micro switch 2090 is activated to stop the power unit 2088 from providing power, when the knob 200 is rotated to a certain position to increase a using time of the power unit 2088. More specifically, the certain position corresponds to OFF state of the device for providing heat source or fire. In the present embodiment, because the driving unit 202 comprises the sliding rail 2020, the wear plate 110 of FIG. 3 is disposed in a middle hole of the driving unit 202, in other words, in the first embodiment, the wear plate 110 is disposed in the knob 100 away from a center position of the knob 100; in the second embodiment, the wear plate 110 is disposed in the knob 200 near the center position of the knob 200. The wear plate 110 is not shown in FIG. 5.

Figure 7:
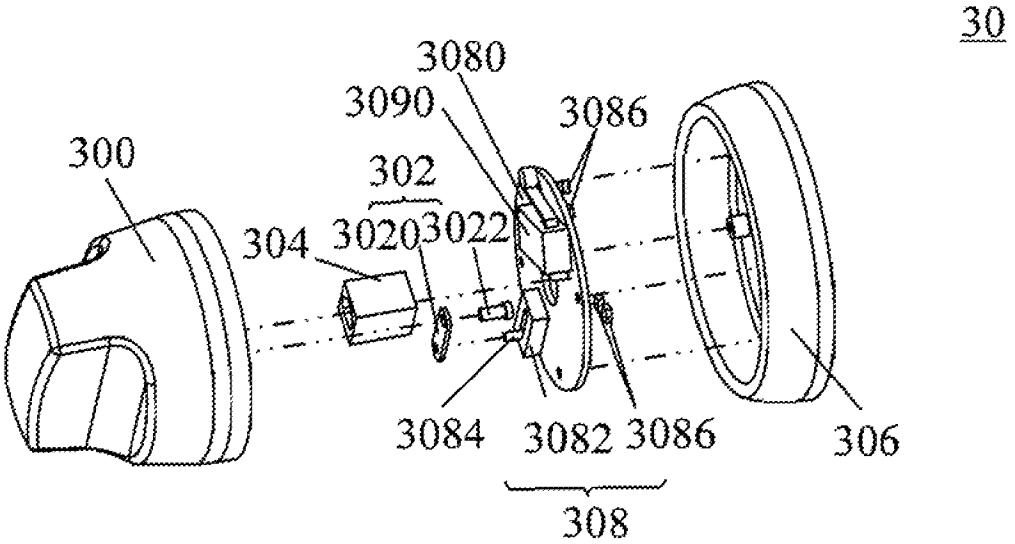
FIG. 7 is an exploded view of a light-emitting knob assembly in accordance with a third embodiment of the present invention.

Please refer to FIG. 7. FIG. 7 is an exploded view of a light-emitting knob assembly 30 in accordance with a third embodiment of the present invention. The isometric, assembled view of the light-emitting knob assembly 30 of the third embodiment of the present invention can be referred to FIG. 1B.

The light-emitting knob assembly 30 is disposed on a device (not shown) for providing a heat source or fire and includes a knob 300, a driving unit 302, an axial bush 304, a base 308 for being fixedly connected to the device, and a light generating unit 308. The device for providing heat source or fire is such as but is not limited to a gas stove, furnace, or electrical stove.

The knob 300 is utilized for being rotated to control the strength of the heat source or the strength of the fire of the device for providing heat source or fire.

The driving unit 302 is fixed in the knob 300. One terminal of the axial bush 304 is fixed in the knob 300, the other terminal of the axial bush 304 is rotatably connected with the device for providing a heat source or fire. More specifically, there is a corresponding axle in the device for providing a heat source or fire, the other terminal of the axial bush 304 rotatably connects with the corresponding axle of the device for providing the heat source or fire.

The light generating unit 308 is fixed in the base 306. The knob 300 is utilized for being rotated to control the strength of the heat source or the strength of the fire of the device, and driving the driving unit 302 and the axial bush 304 to be rotated relative to the light generating unit 308. The light generating unit 308 generates different levels of brightness of lights according to a rotating level of the driving unit 302 with respect to the light generating unit 308 after the driving unit 302 is rotated, to correspondingly display the strength of the heat source or the strength of the fire.

Figure 8:
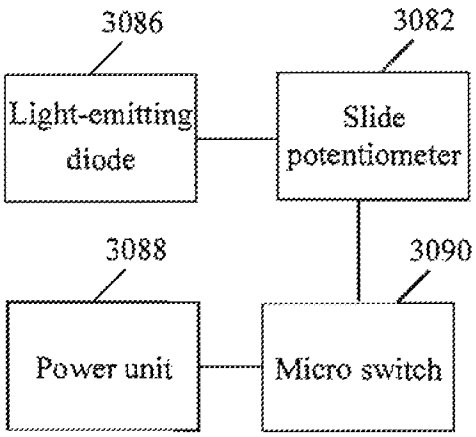
FIG. 8 is a block diagram of interior electrical elements of the light-emitting knob assembly of FIG. 7.

Please refer to FIG. 7 and FIG. 8. FIG. 8 is a block diagram of interior electrical elements of the light-emitting knob assembly 30 of FIG. 7. The driving unit 302 comprises a connecting rod 3020 and a pin 3022. The connecting rod 3020 connects with the knob 300 via the pin 3022. The light generating unit 308 comprises a printed circuit board assembly 3080, a slide potentiometer 3082, at least one light-emitting diode 3086, a power unit 3088, and a micro switch 3090.

The slide potentiometer 3082 is disposed on the printed circuit board assembly 3080 and comprises a sliding rod 3084; the sliding rod 3084 is slidably disposed in the connecting rod 3020. The at least one light-emitting diode 3086 is disposed on the printed circuit board assembly 3080 and is electrically connected to the slide potentiometer 3082. When the knob 300 rotates to make the driving unit 302 rotate, the connecting rod 3020 of the driving unit 302 makes the sliding rod 3084 move, to adjust a resistance value of the slide potentiometer 3082, and to change a current passing through the light-emitting diode 3086. Then, the at least one light-emitting diode 3086 generates light corresponding to the current which is inversely proportional to the resistance value.

The power unit 3088 is used to provide power to the at least one fight-emitting diode 3086. The position of the power unit 3088 is not limited; the power unit 3088 can be disposed inside or outside of the light-emitting knob assembly 30. The micro switch 3090 is electrically connected with the power unit 3088 and the slide potentiometer 3082. The micro switch 3090 is activated to stop the power unit 3088 from providing power, when the knob 300 is rotated to a certain position to increase a using time of the power unit 3088. More specifically, the certain position corresponds to OFF state of the device for providing heat source or fire. The actuation of the micro switch 3090 can be referred by FIG. 3.

In the above embodiments, the quantity or color of the at least one light-emitting diode 1086, 2086, 3086 are not limited. For example, a plurality of light-emitting diodes 1086, 2086, 3086 with the same color are applied to represent the strength of the heat source or the strength of the fire, or a plurality of light-emitting diodes 1086, 2086, 3086 with different colors are applied to represent the strength of heat source or the strength of fire by different colors. For example, in the first embodiment, red, green, and blue light-emitting diodes can be applied, to make the light-emitting knob assembly 10 show different kinds of colors.

Compared with the prior art, the user can know the strength of the heat source or the strength of the fire from a distance by the light-emitting knob assembly of the present invention. Moreover, the light-emitting knob assembly of the present invention has beautiful and decorative function while emitting light.

The above are only preferred embodiments of the present invention, it should be noted that those skilled in the art can also make some improvements and modifications without departing from the principles of the present invention, the premise, these improvements and modifications also should be considered to be within the scope of the present invention.

What is claimed is:

1. A light-emitting knob assembly, which is disposed on a device for providing a heat source or a fire, the light-emitting knob assembly comprising:

a knob;

a light-sensing plate, being fixed in the knob;

an axial bush, one terminal of the axial bush being fixed in the knob, one other terminal of the axial bush being configured to be rotatably connected with the device;

a base fixed to the device; and a light generating unit, being fixed in the base, the light generating unit comprising:

a printed circuit board assembly;

a control unit, being disposed on the printed circuit board assembly;

at least one light sensor, being disposed on the printed circuit board assembly and being electrically connected to the control unit, and sensing different lights reflected by figures of the different regions of the light-sensing plate, after rotating the light-sensing plate, to generate different control signals; and at least one light-emitting diode, being disposed on the printed circuit board assembly and being electrically connected to the control unit, wherein the control unit controls the at least one light-emitting diode to generate different brightnesses or different colors of lights, according to the different control signals;

wherein the knob is utilized for being rotated to control the strength of the heat source or the strength of the fire of the device, and driving the light-sensing plate and the axial bush to be rotated relative to the light generating unit, the light generating unit generates different brightnesses or different colors of lights according to corresponding different regions of the light-sensing plate after the light-sensing plate is rotated, to correspondingly display the strength of the heat source or the strength of the fire.

2. The light-emitting knob assembly of claim 1, wherein the light generating unit further comprises:

a power unit, being used to at least provide power to the at least one light-emitting diode; and a micro switch, being electrically connected with the control unit and the power unit, the micro switch being activated to stop the power unit from providing power, when the knob being rotated to a certain position.

3. The light-emitting knob assembly of claim 1, wherein the other terminal of the axial bush penetrates the light-sensing plate and rotatably connects with the device.

4. A light-emitting knob assembly, which is disposed on a device for providing a heat source or a fire, the light-emitting knob assembly comprising:

a knob;

a driving unit, being fixed in the knob, the driving unit comprising a sliding rail;

an axial bush, one terminal of the axial bush being fixed in the knob, one other terminal of the axial bush being configured for being rotatably connected with the device;

a base fixed to the device; and a light generating unit, being fixed in the base, the light generating unit comprising:

a printed circuit board assembly;

a slide potentiometer, being disposed on the printed circuit board assembly and comprising a sliding rod, the sliding rod being slidably disposed in the sliding rail; and at least one light-emitting diode, being disposed on the printed circuit board assembly and being electrically connected to the slide potentiometer, wherein when the knob rotates to make the driving unit rotate, the sliding rail of the driving unit makes the sliding rod move, to adjust a resistance value of the slide potentiometer, the at least one light-emitting diode generates light corresponding to the resistance value;

wherein the knob is utilized for being rotated to control the strength of the heat source or the strength of the fire of the device, and driving the driving unit and the axial bush to be rotated relative to the light generating unit, the light generating unit generates different brightnesses of lights according to a rotating level of the driving unit with respect to the light generating unit after the driving unit is rotated, to correspondingly display the strength of the heat source or the strength of the fire.

5. The light-emitting knob assembly of claim 4, wherein the light generating unit further comprises:

a power unit, being used to provide power to the at least one light-emitting diode; and a micro switch, being electrically connected with the power unit and the slide potentiometer, the micro switch being activated to stop the power unit from providing power, when the knob being rotated to a certain position.

6. The light-emitting knob assembly of claim 4, wherein the other terminal of the axial bush penetrates the driving unit and rotatably connects with the device.

7. A light-emitting knob assembly which is disposed on a device for providing a heat source or a fire, the light-emitting knob assembly comprising:

a knob;

a driving unit, being fixed in the knob, the driving unit comprising a connecting rod and a pin, the connecting rod connecting with the knob via the pin;

an axial bush, one terminal of the axial bush being fixed in the knob, one other terminal of the axial bush being configured for being rotatably connected with the device;

a base fixed to the device; and a light generating unit, being fixed in the base, the light generating unit comprising:

a printed circuit board assembly;

a slide potentiometer, being disposed on the printed circuit board assembly and comprising a sliding rod, the sliding rod being slidably disposed in the connecting rod; and at least one light-emitting diode, being disposed on the printed circuit board assembly and being electrically connected to the slide potentiometer, wherein when the knob rotates to adjust the strength of the heat source or the strength of the fire of the device and to make the driving unit rotate, the connecting rod of the driving unit makes the sliding rod move, to adjust a resistance value of the slide potentiometer, the at least one light-emitting diode generates light corresponding to the resistance value, to correspondingly display the strength of the heat source or the strength of the fire.

8. The light-emitting knob assembly of claim 7, wherein the light generating unit further comprises:

a power unit, being used to provide power to the at least one light-emitting diode; and a micro switch, being electrically connected with the power unit and the slide potentiometer, the micro switch being activated to stop the power unit from providing power, when the knob being rotated to a certain position.

9. A light-emitting knob assembly, which is disposed on a device for providing a heat source or a fire, the light-emitting knob assembly comprising:

a knob;

a light-sensing plate, being fixed in the knob;

an axial bush, one terminal of the axial bush being fixed in the knob, one other terminal of the axial bush being configured to be rotatably connected with the device;

a base fixed to the device; and a light generating unit, being fixed in the base, the light generating unit comprising:

a printed circuit board assembly;

a control unit, being disposed on the printed circuit board assembly;

at least one light sensor, being disposed on the printed circuit board assembly and being electrically connected to the control unit, and sensing different lights reflected by figures of the different regions of the light-sensing plate, after rotating the light-sensing plate, to generate different control signals; and at least one light-emitting diode, being disposed on the printed circuit board assembly and being electrically connected to the control unit, wherein the control unit controls the at least one light-emitting diode to generate different brightnesses and different colors of lights, according to the different control signals;

wherein the knob is utilized for being rotated to control the strength of the heat source or the strength of the fire of the device, and driving the light-sensing plate and the axial bush to be rotated relative to the light generating unit, the light generating unit generates different brightnesses and different colors of lights according to corresponding different regions of the light-sensing plate after the light-sensing plate is rotated, to correspondingly display the strength of the heat source or the strength of the fire.

* * * * *